US005547532A

United States Patent [19]

Wernersbach, Jr. et al.

[11] Patent Number: 5,547,532

[45] Date of Patent: Aug. 20, 1996

[54] DIRECT WIND COIL WINDING HEAD ASSEMBLY

[75] Inventors: Arthur W. Wernersbach, Jr., Waxahachie; John R. Skaritka, DeSoto; Billy P. Yager; Rodney R, Barrick, both of Waxachachie; John D. Ligier, Arlington, all of Tex.

[73] Assignee: Universities Research Association, Inc., Washington, D.C.

[21] Appl. No.: 217,190

[22] Filed: Mar. 23, 1994

[51] Int. Cl.[6] ..... B65H 81/00

[52] U.S. Cl. ..... 156/172; 29/605; 140/92.2; 140/93 R; 156/169; 156/425; 156/428; 156/429; 156/308.2; 156/320; 242/418; 242/437.1; 335/229

[58] Field of Search ..... 242/7.03, 7.07, 242/418, 418.1; 140/93 R, 92.1, 92.2; 29/605; 335/229; 156/428, 429, 425, 172, 169, 173, 175, 308.2, 320

[56] References Cited

U.S. PATENT DOCUMENTS

| | | | |
|---|---|---|---|
| 2,985,393 | 5/1961 | Zander | 242/418 X |
| 4,547,238 | 10/1985 | Lenders | 242/7.03 X |
| 4,668,544 | 5/1987 | Takahashi . | |
| 5,160,568 | 11/1992 | Gruber | 156/425 X |
| 5,213,646 | 5/1993 | Zsolnay et al. | 156/172 |
| 5,331,729 | 7/1994 | Moorehead | 242/7.07 X |

FOREIGN PATENT DOCUMENTS

| | | |
|---|---|---|
| 0081446 | 6/1983 | European Pat. Off. . |
| 3912334 | 10/1990 | Germany . |
| 2147561 | 5/1985 | United Kingdom . |

*Primary Examiner*—Jeff H. Aftergut
*Attorney, Agent, or Firm*—Elizabeth A. Mark

[57] ABSTRACT

A direct wind coil winding head assembly for depositing coil windings directly onto a coil support mandrel, comprising wire feed means having an input and an output, the wire feed means adapted to receive a continuous length of wire at the input and to cause the wire to exit the output at a first rate, mandrel positioning means for dynamically positioning the coil support mandrel beneath the output and control means coupled to the wire feed means and the mandrel positioning means, the control means operable to cause the mandrel positioning means to dynamically position the coil support mandrel beneath the output such that the exiting wire is deposited onto the mandrel in a predetermined pattern, and further operable to control the wire feed means such that the first rate is substantially equal to a second rate of movement of the coil support mandrel relative to the output, whereby the wire is deposited onto the coil support mandrel with substantially no residual winding stresses. Other systems, devices and methods are disclosed.

18 Claims, 6 Drawing Sheets

DIRECT WIND COIL WINDING HEAD ASSEMBLY

TECHNICAL FIELD OF THE INVENTION

The present invention relates generally to a coil winding head assembly and more particularly to a direct wind coil winding head assembly used to deposit wire or other types of conductors onto a coil support mandrel.

BACKGROUND OF THE INVENTION

Many applications require the use of coils of conductive wire, ribbon or tape to be wound around various shaped objects and/or in various shaped patterns. Some of these applications, such as the stator and rotor windings of normal DC motors, require very little precision in the placement of the winding turns and hence many high speed methods are capable of performing this type of coil winding. Other applications, such as the windings for superconducting magnets, require much greater precision in wire placement and winding methods in order to extract peak performance from any particular winding configuration.

The magnetic field strength generated by such magnets is directly related to the current densities that can be handled by the windings. Current density is directly related to the amount of space left between coil conductors after the coil has been wound. It is therefore important that any winding method used with such superconducting magnet coils produce coils with zero interconductor spacing (i.e. each conductor in the coil touches its neighbors). Such a winding is known as an ordered winding. Such tight packing of the coil conductors reduce the amount of movement of the conductors after the coil has been wound (such as when the magnet is brought to the very low temperatures at which the superconducting magnets operate). Such movement of the conductors would disrupt the magnetic field.

Prior art techniques for producing ordered wound coils require very costly tooling for each winding pattern. This requires very large sums of money to be expended for research and development of new coil designs, as well as a large capital expenditure for each coil design required. Once a coil design is tooled for production, the design cannot be changed without retooling.

Furthermore, superconductor wires, such as niobium titanium within a copper billet, are brittle. Prior art winding techniques impart residual stresses into the windings which accumulate as more turns are added to the winding. These residual winding stresses can act to damage the superconductor wires used in the windings, decreasing the magnet's performance.

There is therefore a need in the prior an for a method to produce ordered wound coils without the need for retooling the device for different coil designs. There is also a need for a method to produce ordered wound coils without producing residual winding stresses in the coil conductors. The present invention is directed toward meeting these needs.

SUMMARY OF THE INVENTION

It is therefore the object of the present invention to provide a .direct wind coil winding head assembly that may be used with a standard computer numerically controlled (CNC) machine tool to produce ordered wound coils.

It is another object of the present invention to provide a direct wind coil winding head assembly that will allow different coil designs to be wound without the need for retooling.

It is a further object of the present invention to provide a direct wind coil winding head assembly that will allow ordered wound coils to be produced without residual winding stresses.

Other and further objects of the present invention will become apparent from a reading of the following description taken in conjunction with the appended claims.

In order to meet the forgoing objectives and to overcome the problems inherent in the prior art devices, the present invention provides a direct wind coil winding head assembly that uses a conventional CNC machine tool to control the rate of wire feed and the positioning of the coil mandrel so that the wire can be deposited to the mandrel with no residual winding stress.

In one form of the invention, a direct wind coil winding head assembly for depositing coil windings directly onto a coil support mandrel is disclosed, comprising wire feed means having an input and an output, the wire feed means adapted to receive a continuous length of wire at the input and to cause the wire to exit the output at a first rate, mandrel positioning means for dynamically positioning the coil support mandrel beneath the output and control means coupled to the wire feed means and the mandrel positioning means, the control means operable to cause the mandrel positioning means to dynamically position the coil support mandrel beneath the output such that the exiting wire is deposited onto the mandrel in a predetermined pattern, and further operable to control the wire feed means such that the first rate is substantially equal to a second rate of movement of the coil support mandrel relative to the output, whereby the wire is deposited onto the coil support mandrel with substantially no residual winding stresses.

In another form of the invention, a direct wind coil winding head assembly for depositing coil windings directly onto a coil support mandrel is disclosed, comprising a source of rotational energy operable at variable rates of rotation, a rotatable shaft coupled to the source of rotational energy, wire feed means driven by the rotatable shaft and having an input and an output, the wire feed means adapted to receive a continuous length of wire at the input and to cause the wire to exit the output at a first rate, a longitudinal feed table operable to move on a longitudinal axis, a rotary table coupled to the longitudinal feed table and operable to rotate in a plane at substantially a right angle to the longitudinal axis, the longitudinal feed table and the rotary table jointly operable to hold a coil support mandrel such that the mandrel may be moved along the longitudinal axis and rotated about an axis parallel to the longitudinal axis, and a digital computer coupled to and controlling the source of rotational energy, the longitudinal feed table and the rotary table, the computer operable to cause the mandrel to be dynamically positioned beneath the output according to stored program instructions and to cause the exiting wire to be deposited onto the mandrel in a predetermined pattern at a second rate substantially equal to the first rate, whereby the wire is deposited onto the coil support mandrel with substantially no residual winding stresses.

In another form of the invention, a method for direct winding of a coil on a coil support mandrel is disclosed, comprising the steps of (a) coating a surface of the mandrel with a first adhesive; (b) supplying a continuous length of conductor coated, with a second adhesive, to a first point; (c)

moving the mandrel such that the first point coincides with successive adjacent second points on the mandrel surface wherein the second points define a winding pattern of the coil; and (d) controlling steps (b) and (c) such that the conductor is supplied at a first rate substantially equal to a second rate of movement of the mandrel relative to the point.

BRIEF DESCRIPTION OF THE DRAWINGS

The novel features believed to be characteristic of the invention are set forth in the appended claims. For a more complete understanding of the present invention, and for further details and advantages thereof, reference is now made to the following Detailed Description taken in conjunction with the accompanying drawings, in which:

It is to be expressly understood, however, that the drawings are for purposes of illustration only and are not intended as a definition of the limits of the invention. Such definition is made only by the appended claims.

DETAILED DESCRIPTION OF THE DRAWINGS

Figure 1:
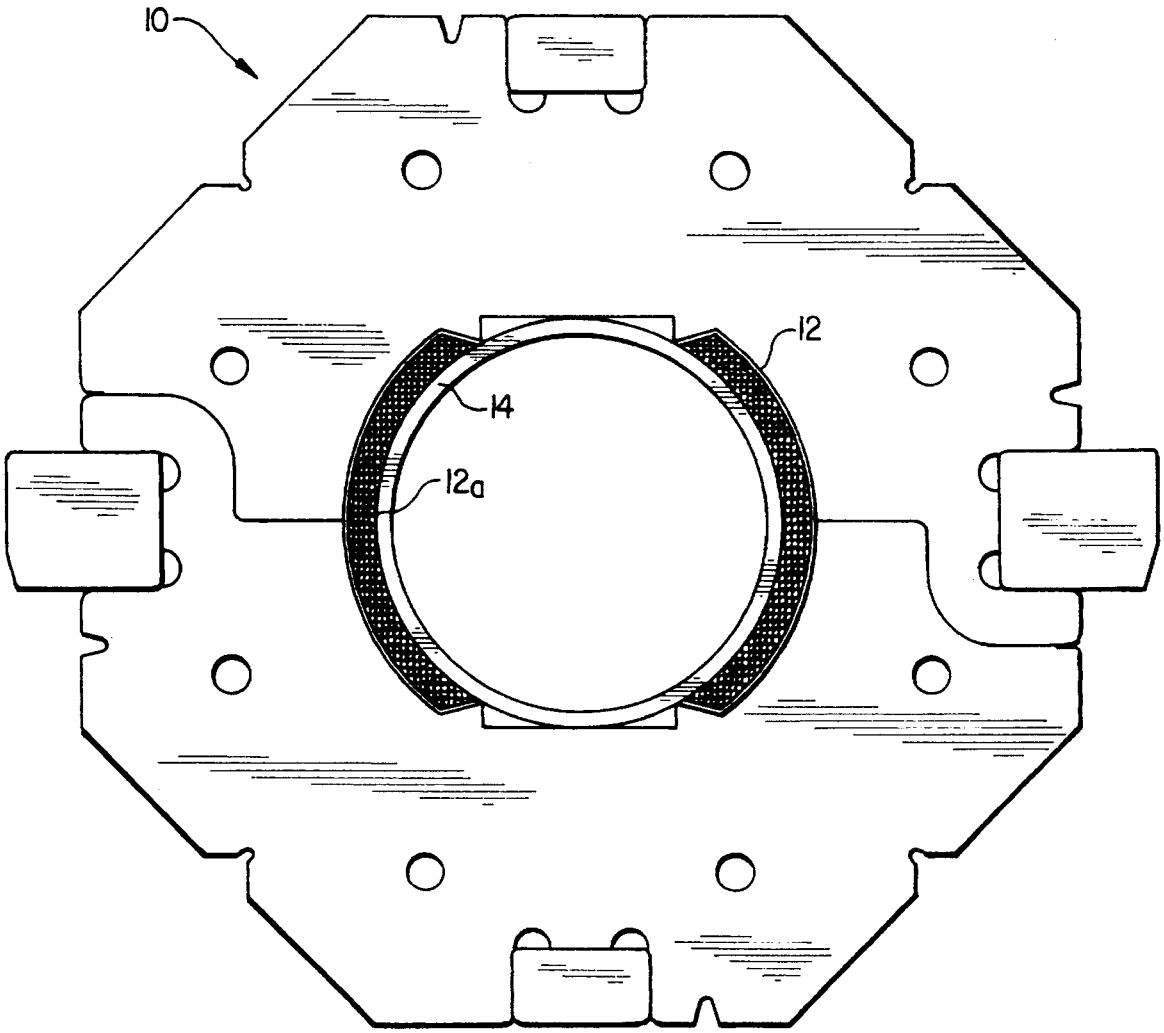
FIG. 1 is a cross-sectional view of an ordered wound coil of the present invention.

The present invention relates to coil winding head assemblies. FIG. 1 is a cross-sectional view of a superconducting magnet 10 wound according to the present invention. It will be appreciated by those skilled in the art that each of the conductors 12 of the magnet 10 has been placed in a uniform, closely packed grid. In reality, there is only a single conductor 12, which crosses the plane of the cross section repeatedly, as will become apparent with reference to FIG. 2. It is however, more intuitive to speak of the conductors in the plural sense, especially when viewing a cross section, and that practice will be adhered to throughout this description. Each of the conductors 12 rests on its four closest neighbors in a regularly repeating grid. This arrangement minimizes the amount of void (non-conductor) space between the conductors 12, thereby increasing the current density of the coil and hence its magnetic field strength. Additionally, the turns of the coil are built up in the configuration of a truncated pyramid. The level one conductors 12*a* are placed directly on a mandrel 14 as will be explained hereinbelow. Each of the conductors 12 on levels two or above of the coil are placed so as to nest between two conductors on the next lower level. Therefore, each higher level of the coil has one less conductor winding than the level below it.

Figure 2:
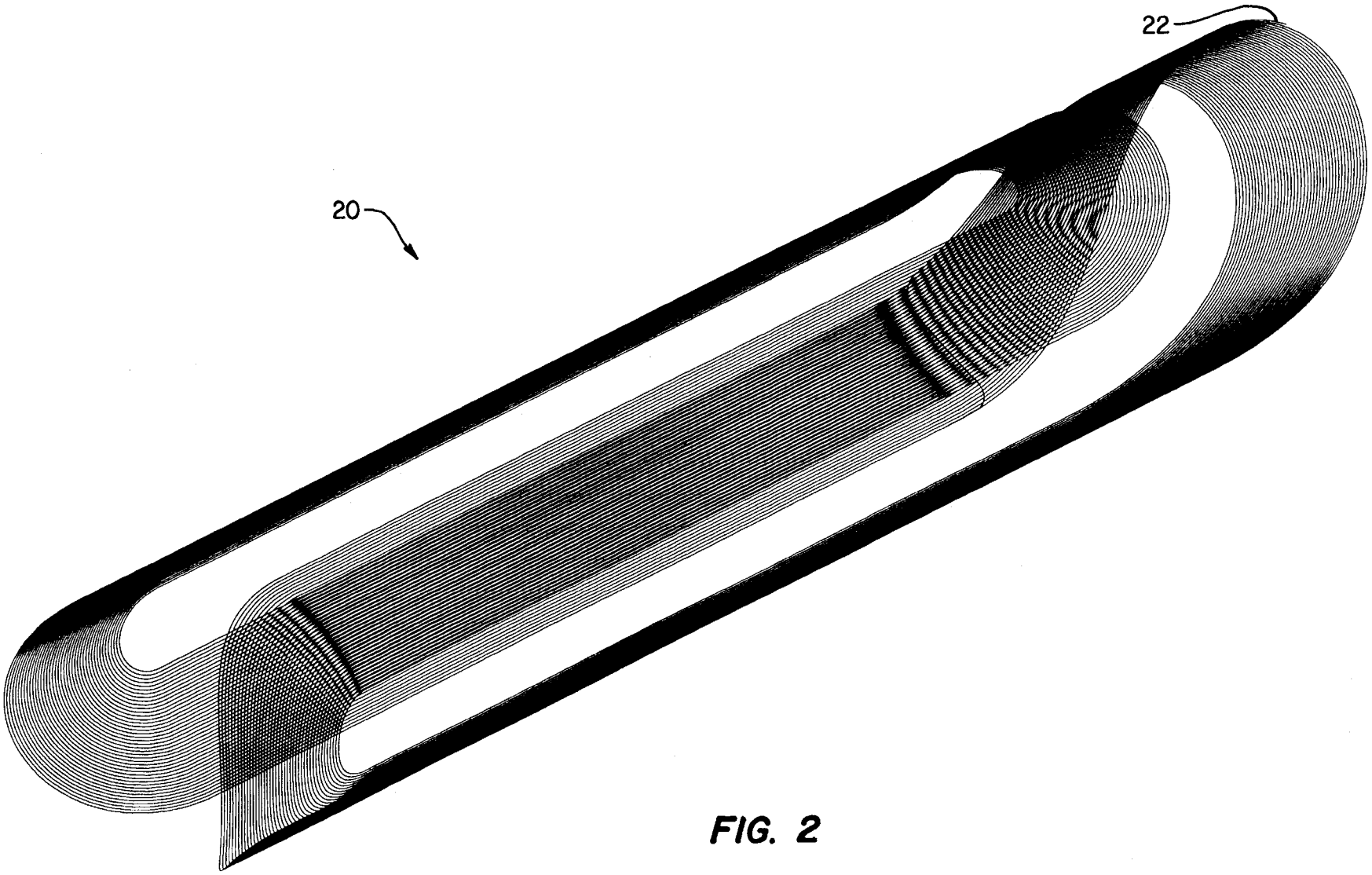
FIG. 2 is an isometric view of a first level of coil winding of a direct wind coil produced by the method and apparatus of the present invention.

Referring now to FIG. 2, there is illustrated an isometric view of a single level of a coil winding 20 for a quadrupole magnet. It will be appreciated that although the coil 20 makes several bends and turns in three dimensions, it is desirable that each of the conductors 22 be spaced close enough to its neighbors such that another conductor 22 may be laid on a second level of the winding 20 and rest between two of the conductors 22 on the first level of the winding 20. The present invention encompasses an apparatus and method for winding a such a coil and providing for such close packing, while eliminating residual stresses in the coil winding.

Figure 3:
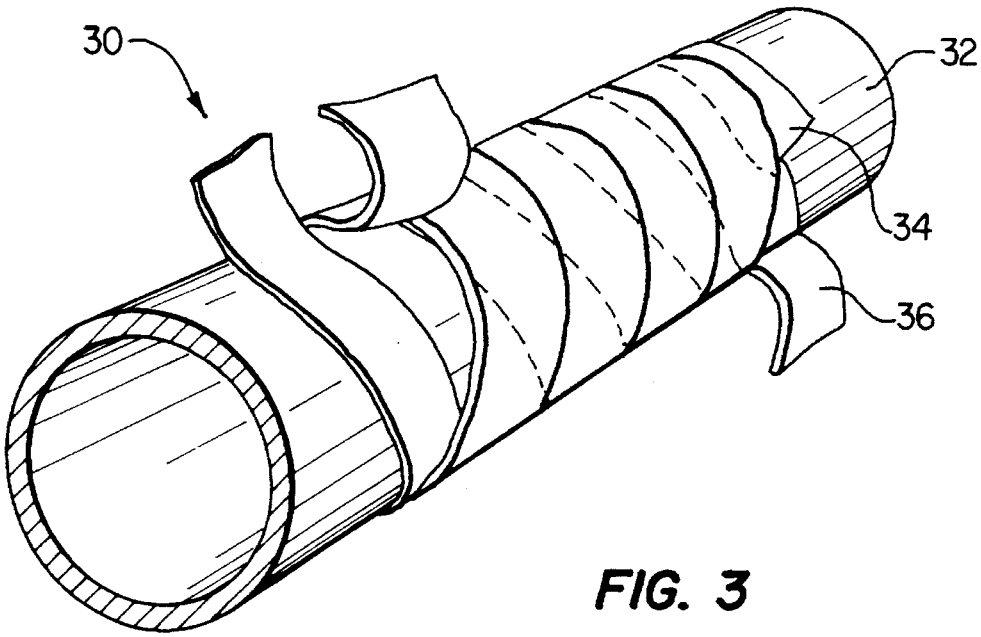
FIG. 3 is an isometric view illustrating preparation of the mandrel of a coil wound according to the present invention.
Figure 4A:
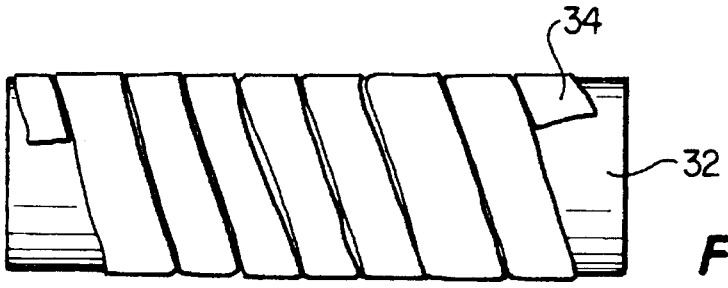
FIGS. 4*a–c* are plan views illustrating the steps in the preparation of the mandrel of a coil wound according to the present invention.
Figure 4B:
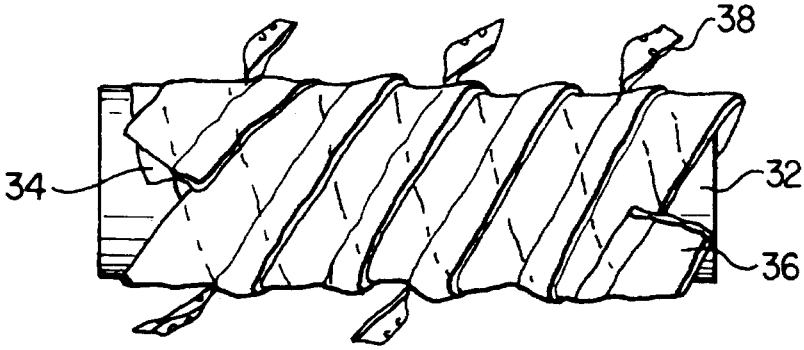
Figure 4C:
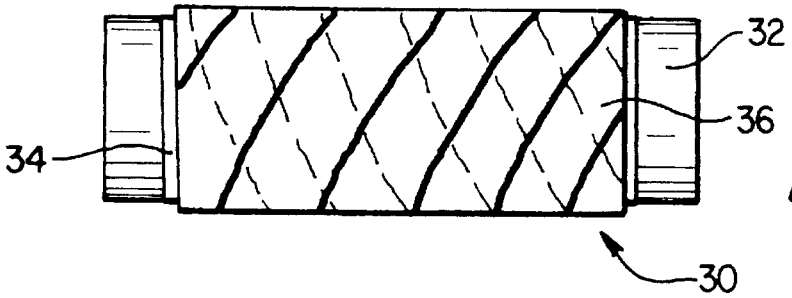

The winding 20 of FIG. 2 is formed on a coil support mandrel which is not shown in the drawing so that the individual turns of the coil 20 may be more clearly illustrated. Such a coil support mandrel is illustrated in FIG. 3 and indicated generally at 30. Mandrel 30 comprises a tubular base 32 made of any suitable material and forming a rigid surface onto which the coil may be wound. A spiral wrap 34 of polyamide tape, such as Kapton tape which is a polyamide tape with adhesive film on one side and which is commercially available from Dupont, is placed on the base 32. A second spiral wrap 36, spiraling in the opposite direction of the wrap 34, is placed over the wrap 34. Spiral wrap 36 is made of a tape with an exterior film coating having thermoplastic properties on at least one side. Spiral wraps 34, 36 form the mounting surface for the direct wind coil. FIG. 4*a* illustrates the first step in the preparation of the coil support mandrel 30. A length of spiral wrap tape 34 is spiral wrapped onto the tubular base 32 to a sufficient length to accommodate the desired coil length in longitudinal direction. The adhesive side of the spiral wrap 34 is positioned on the exterior of the spiral. This allows a slip plane to be formed between the tubular base 32 and the underside of the spiral wrap 34. This slip plane is important because it tends to minimize movement of the coil when the structure is cooled to superconducting temperatures and the tubular base 32 changes its dimensions relative to the coil. Next, in FIG. 4*b*, spiral wrap 36 is applied in a reverse spiral over the spiral wrap 34 and held in place by the adhesive side of the spiral wrap 34. The spiral wrap 36 is applied so that each turn partially overlaps the previous turn. The overlapping edges are then trimmed with a blade 38. Finally, in FIG. 4*c*, the ends of both the spiral wrap 34 and the spiral wrap 36 are trimmed to provide clean edges. The spiral wrap 36 is coated on the exterior side with an adhesive having thermoplastic properties that will be used to bond the coil to the mandrel. This adhesive having thermoplastic properties should have a flowing temperature comparable to that of the adhesive coating wire 22 such that when the heated adhesive on the wire first comes in contact with the adhesive on spiral wrap 36 it causes the adhesive having thermoplastic properties on the mandrel to flow. A preferred adhesive is Scotch-Weld 2.290-R (62-2290-7502-3) manufactured by 3M. The adhesive may be applied before or after wrapping the spiral wrap 36 onto the mandrel. The coil support mandrel 30 is then ready for direct winding of the desired coil.

Referring once again to FIG. 2, a direct wind coil such as the coil 20 may be wound on the coil support mandrel 30. The direct wind process refers to the process of placing the conductors 22 of the coil 20 directly on the mandrel as the coil is wound. This differs from the prior art methods in that the prior art coils are wound on a separate jig and then formed into the shape of the coil 20 (or whatever coil shape is desired). In order to directly wind the coil 20 onto the coil support mandrel 30, it is necessary that the conductor 22 be attached to either the mandrel 30 (for level one conductors;

wire-to-mandrel adhesion) or to the lower conductors 22 (for level two and above conductors; wire-to-wire adhesion) as the conductor 22 is being laid. The adhesive having thermoplastic properties on the exterior of the spiral wrap 36 is provided for the wire-to-mandrel adhesion. In addition, the conductor 22 is also coated with an adhesive having thermoplastic properties, such as Bondall 16-H. The adhesives having thermoplastic properties flow above a predetermined temperature, therefore if the conductor 22 is heated prior to winding the coil, the conductor 22 will adhere to the mandrel 30 during the first level of coil winding, and to lower level wires during the level two and above windings. By using this adhesive method, the windings of the coil 20 will adhere to the surface of the coil support mandrel 30 and remain positioned where they are placed, in a tight packing arrangement.

In addition to the slip plane provided for thermal expansion and contraction between the coil support mandrel 30 and the coil winding 20, the conductor 22 is made of a multifilament wire wrapped in a polyamide film. This provides a micro-slip plane between the wire and the polyamide film. When the conductors 22 are bonded to each other, the multifilament wire within the polyamide film sleeve is still free to slide therein, further reducing thermal and winding stress of the conductors 22.

Figure 5:
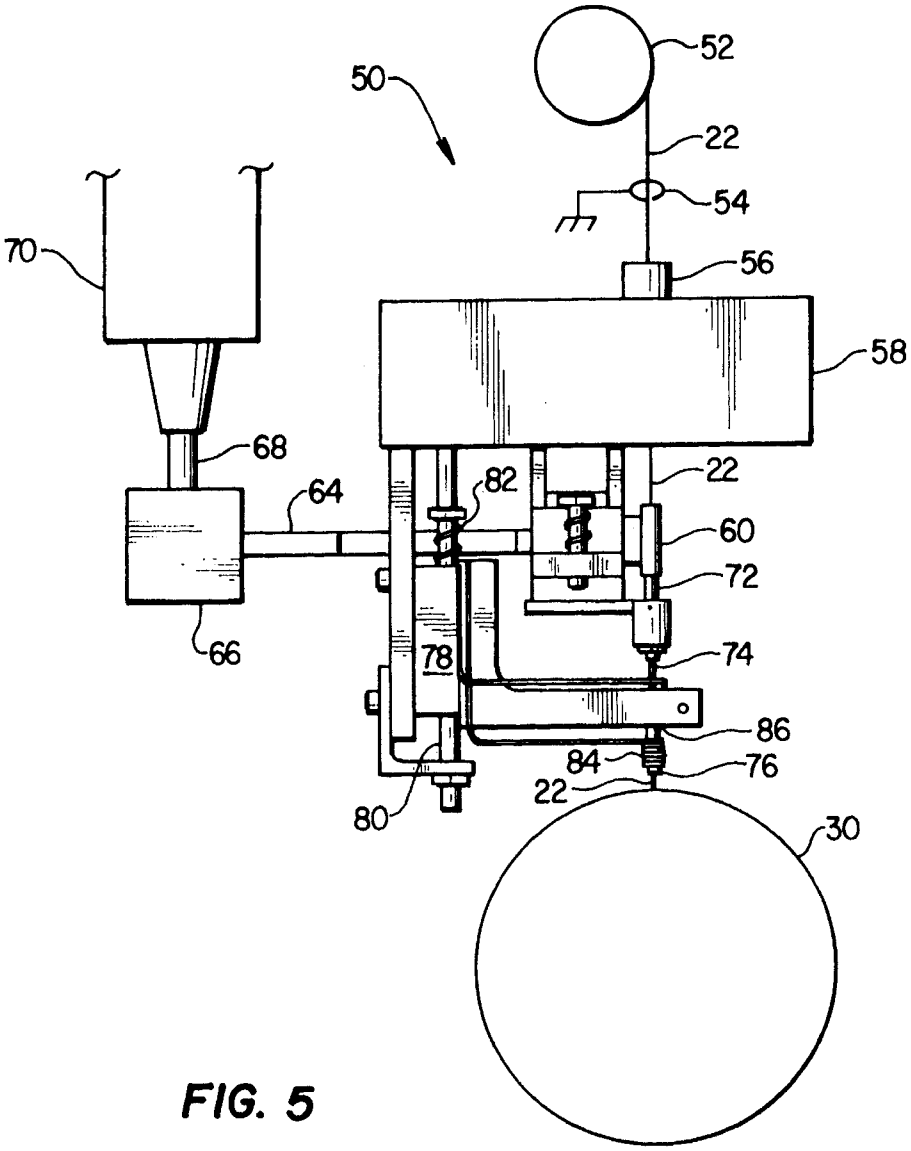
FIG. 5 is a first plan view of the direct wind coil winding head assembly of the present invention.

The combination of the coil support mandrel 30 and the adhesives of the spiral wrap 36 and of the conductor 22 allow attachment of the conductor 22 to the mandrel 30 in any winding pattern desired, so long as a heated conductor 22 can be laid down at any point on the coil support mandrel 30 (the conductor 22 must be heated in order to flow the adhesives). An apparatus for placing the conductor 22 onto the mandrel 30 is shown in FIG. 5 and indicated generally at 50. FIG. 5 shows the direct wind coil winding head assembly 50 from the side, hence coil support mandrel 30 is also illustrated from the side view. The conductor wire 22 is fed from a supply spool 52 and passed through a fixed guide eyelet 54 into a guide tube 56. Guide tube 56 feeds the wire 22 through the assembly mounting base 58 such that it is fed into two pinch rollers 60 and 62. Only pinch roller 60 is visible in the view of FIG. 5. One of the pinch rollers has a flat wire contact surface while the other has a V-shaped notch in which the wire 22 rests as it travels through the rollers. Pinch roller 62 is driven by a powered shaft 64 which is in turn driven by the spindle 68 of a CNC machine tool 70. Connection between the spindle 68 and the powered shaft 64 may be conveniently made through a right angle gear box 66. As the wire 22 exits the bottom of the pinch rollers 60 and 62, it is fed through upper wire guide tube 72, middle wire guide tube 74 and lower wire guide tube 76 from which it exits to be placed upon the surface of coil support mandrel 30. The entire lower section of the coil winding head assembly 50 is mounted to plate 78 which is free to translate in the vertical direction on rod 80. A spring 82 biases the plate 78 in the downward direction.

The wire 22 is heated as it passes through the lower wire guide tube 76 by a calrod resistive heating element 84 that is spirally wrapped around the lower wire guide tube 76. The operation of the heating element 84 is controlled by feedback from a temperature sensing probe 86 so that the temperature of the conductor 22 passing through the lower wire guide tube 76 is maintained above the flow temperature of the adhesive coating the wire 22 and the mandrel 30.

Figure 6:
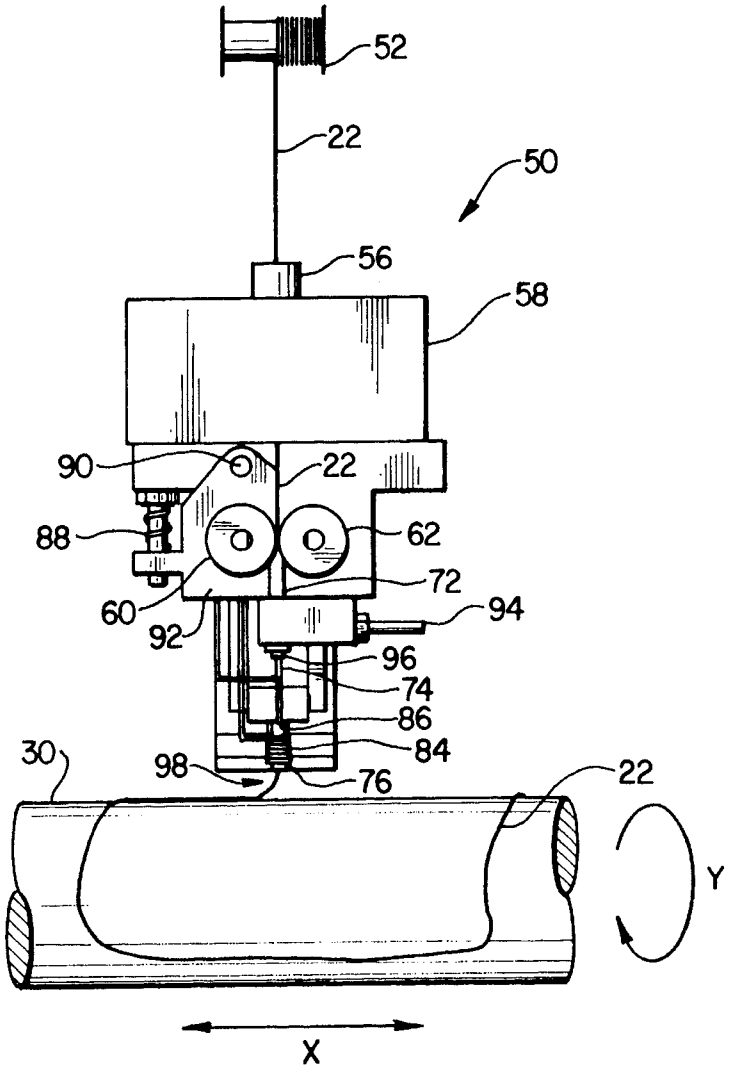
FIG. 6 is a second plan view of the direct wind coil winding head assembly of the present invention.

Referring now to FIG. 6, the direct wire coil winding head assembly of FIG. 5 is seen from head on. In this view, both of the pinch rollers 60 and 62 are visible. The pinch roller 62 is driven by the powered shaft 64 directly, while the pinch roller 60 is driven by the pinch roller 62 through a series of gears (not visible; see FIG. 7). The pinch roller 60 is maintained in contact with pinch roller 62 by means of a biasing spring 88 which forces the pinch roller mounting plate 92 to pivot around pivot 90. This also forces the gear of pinch roller 60 to mesh with the gear of pinch roller 62 (see FIG. 7). An attachment 94 is provided for supplying air to exit through an aperture 96 near the middle wire guide tube 74. This flow of air is used to create a thermal barrier which keeps the heat generated by the heating element 84 from migrating up the head assembly 50. This is necessary in order to keep the adhesive coating the wire 22 from flowing before it reaches the lower wire guide tube 76.

Figure 7:
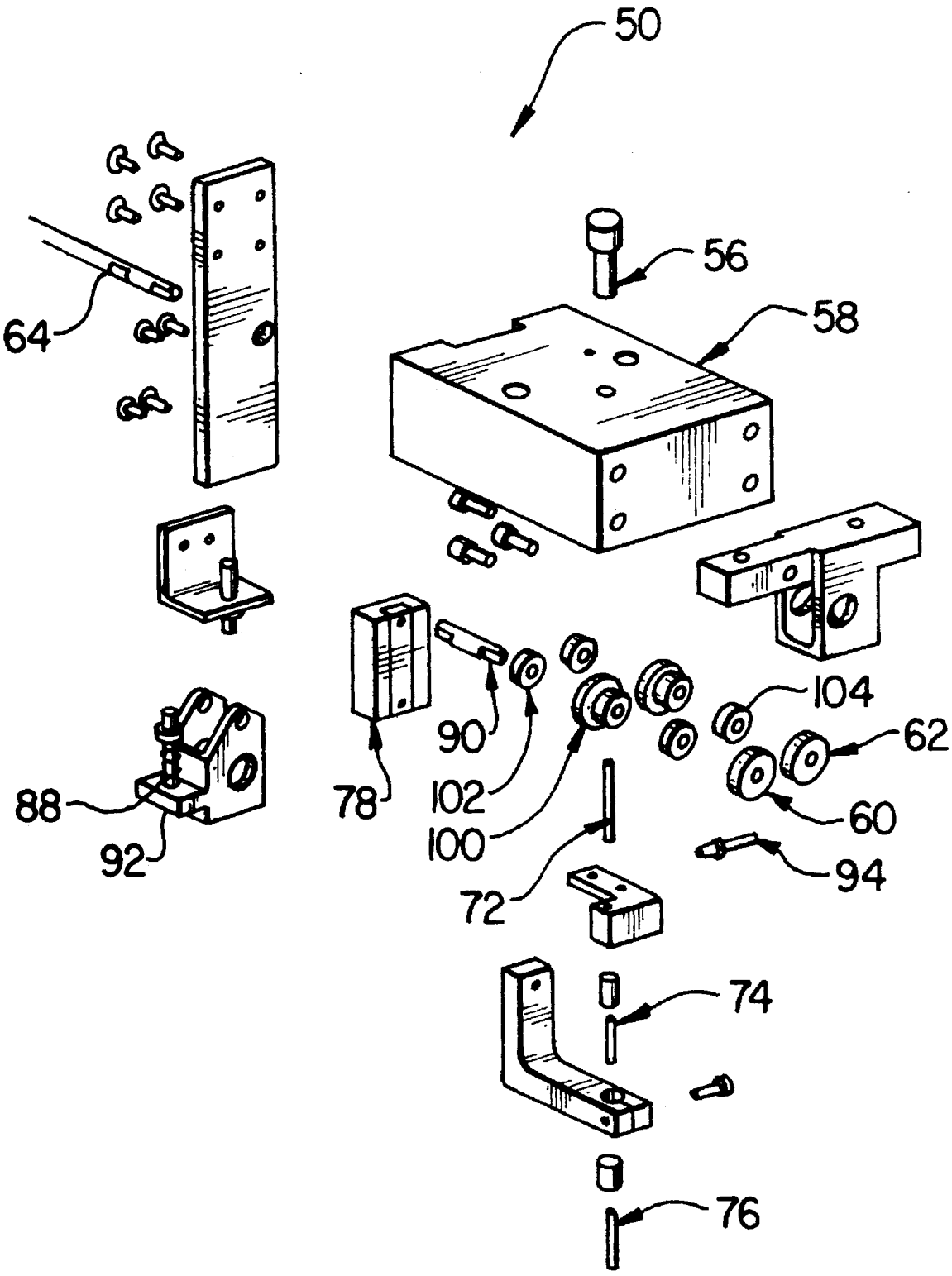
FIG. 7 is an exploded view of the direct wind coil winding head assembly of FIGS. 5 and 6.

Referring now to FIG. 7, the direct wind coil winding head assembly 50 is shown in an exploded view. Visible in FIG. 7 are the gears 100 and associated bearings 102 and 104 which are used to drive pinch rollers 60 and 62.

Figure 8:
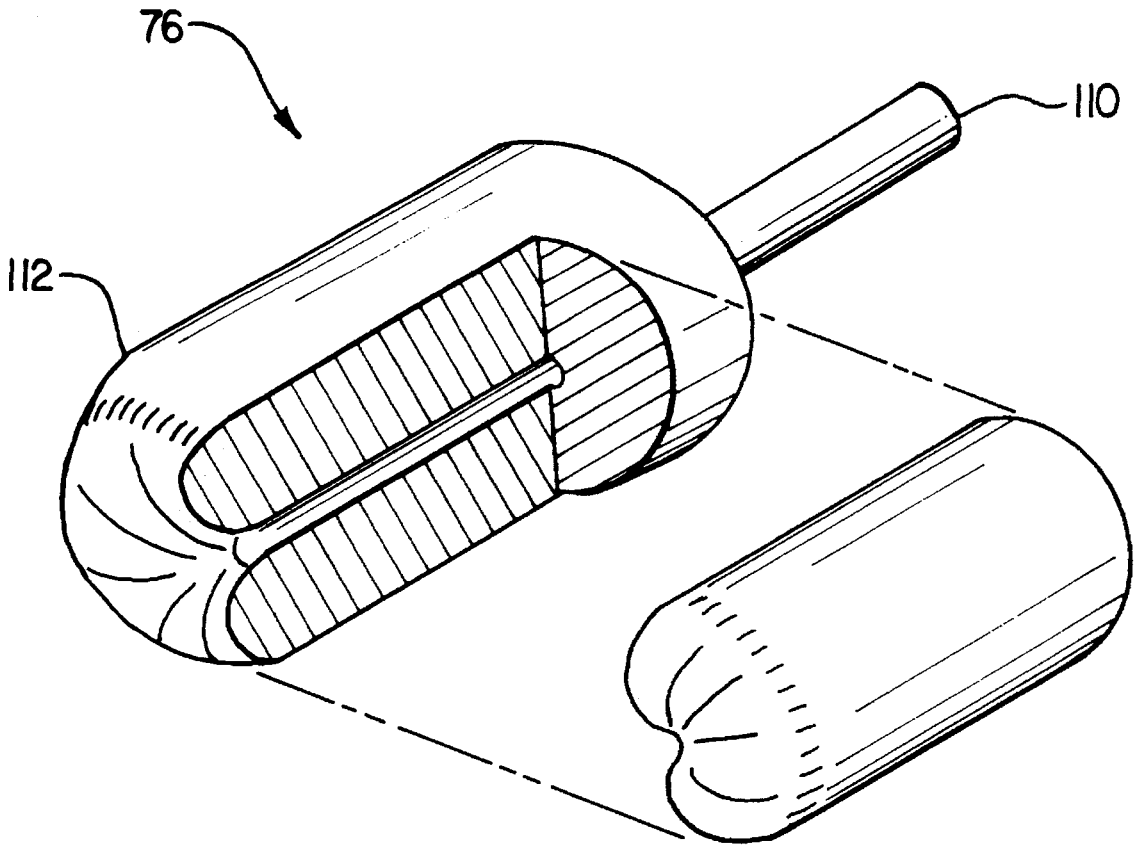
FIG. 8 is a partial cross-sectional view of the lower wire guide tube of the present invention.

Referring now to FIG. 8, there is illustrated a partial cross-sectional view of the lower wire guide tube 76 of the present invention. The upper section 110 is a hollow tube preferably made from stainless steel. The lower section 112 is preferably made from brass in order to more efficiently conduct heat to the wire 22 from the heating element 84 (see FIGS. 5 and 6) wrapped therearound. The bottom of the section 112 is rounded into a toroidal shape. This allows the wire 22 to exit the guide tube 76 in any direction without binding on a sharp or abrupt edge, thereby preventing damage to the wire 22.

The direct wind coil winding head assembly 50 of FIGS. 5–7 remains in a stationary position as the coil is wound onto the mandrel 30. The mandrel 30 is coupled to the numerically controlled table (not shown) of the CNC machine tool 70 and may be moved in the X direction by longitudinal feed of this table. Movement in the Y direction (circumferentially around the coil support mandrel 30) is accomplished by rotation of the coil support mandrel 30 about its longitudinal axis. Such rotation may be conveniently accomplished by a numerically controlled rotary table (not shown) mounted at a right angle to the table of the CNC machine tool. Movement in the Z direction (the vertical height of the head assembly 50 above the surface of the mandrel 30) is controlled by the vertical height control of the CNC machine tool's spindle 68. Adjustment of this vertical height is required so that the head assembly 50 may move upward as more levels of coil 20 are added.

In operation, movement of the CNC machine tool 70, including its longitudinal feed table and rotary table, is controlled by an attached computer with appropriate interfaces, as is known in the art. After the three dimensional coil 20 has been designed, the CNC machine tool computer is programmed to move its feed table, rotate its rotary table and adjust the height of its spindle so that the position directly below the lower wire guide tube 76 traces out the path of the coil winding on the mandrel 30 (for level one turns) or on lower level conductors 20 (for level two and above turns). Methods for programming the CNC machine tool 70's computer to accomplish this task are notoriously well known in the art. As the computer is moving the coil support mandrel 30 in the path of the coil 20 winding, it is simultaneously calculating the linear length of wire which must be deposited on the mandrel 30 in order to keep up with the motion of the mandrel 30. Using this information, the computer rotates the spindle 68, which it has precise control of, at a rate that will feed exactly the required amount of wire 22 through the pinch rollers 60 and 62, through the wire guide tubes 72–76, and onto the mandrel 30. Rotation of the pinch rollers 60 and 62 occurs at a fixed ratio to rotation of the spindle 68 through right angle gear 66, powered shaft 64 and the gears 100 (see FIG. 7) attached to the pinch rollers 60 and 62. As the wire 22 is fed through the lower wire guide tube 76, it is heated by the electric heating element 84 to a temperature that flows the adhesive on its surface. The wire then exits the guide tube 76 and is laid down on the coil. The heated adhesive on the exiting wire 22 is hot enough to flow the adhesive on the mandrel 30 (level one coil turns) or on the lower conductors 22 (level two and above turns) so that the wire is bonded to the rest of the coil as it is laid down. Because the CNC machine tool 70 can control placement of the wire to tolerances in the 1/10,000 of an inch range, the resulting coil 20 structure is extremely tightly packed, with virtually no space between one conductor 22 and its neighbors. Additionally, the gentle arc 98 which the wire 22 follows between the lower wire guide tube 76 and the coil surface prevents the head assembly 50 from contacting the coil 20, thereby eliminating the possibility of damage to the coil or the conductors by physical interference from the head assembly 50.

An important advantage of the present invention is that because the wire 22 is fed at exactly the same rate as the movement of the coil winding surface, the coil winding 20 is laid down with no residual winding stress. Another important advantage of the present invention is that because the computer has complete control of the spindle and CNC machine tool 70 tables, the wire 22 can be laid down in any pattern whatsoever. This means that the coil 20 design can be changed with no retooling required. Only a simple program change to the computer is required to load the data for the new coil pattern. This is a significant improvement over the prior art in many respects. First, the coil may be wound using a CNC machine tool that is found in any machine shop. The cost of the direct wind coil winding head assembly 50 which mounts to the CNC machine tool 70 is negligible compared to the cost of specialized prior art coil winding machines. Secondly, the same machine can be used to produce an unlimited number of coil designs without retooling; the only change required is the loading of a new software program. Finally, research and development of new coil designs is made much easier because new designs can be fabricated without the expense of retooling, allowing for more iterations in the design without much added expense (only the cost of the coil materials).

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. For example, mandrels of any configuration may be used to wind the coils, not just tubular mandrels. Additionally, a five axis CNC machine tool (movable spindle orientation) would allow winding of coils using conductive ribbon or tape. This would allow placement of the ribbon so that it exits the head assembly tangential to the surface of the mandrel. Accordingly, the present invention is intended to encompass such rearrangements, modifications, and substitutions of pans and elements as fall within the scope of the appended claims.

What is claimed is:

1. A method for direct winding of a coil on a coil support mandrel, comprising the steps of:

(a) coating a surface of said mandrel with a first adhesive;

(b) supplying a continuous length of conductor coated, with a second adhesive, to a first point;

(c) moving said mandrel such that said first point coincides with successive adjacent second points on said mandrel surface wherein said second points define a winding pattern of said coil; and (d) controlling steps (b) and (c) such that said conductor is supplied at a first rate substantially equal to a second rate of movement of said mandrel relative to said point.

2. The method of claim 1, further comprising of the step of:

(e) heating said conductor in a region near said first point to a first temperature high enough to flow said first and second adhesives.

3. The method of claim 2, further comprising the steps of:

(f) measuring a second temperature near said first point; and (g) using said measured second temperature to control said heating in step (e).

4. A direct wind coil winding head assembly for depositing coil windings directly onto a coil support mandrel, comprising:

wire feed means having an input and an output, said wire feed means adapted to receive a continuous length of wire at said input and to cause said wire to exit said output at a first rate;

mandrel positioning means for dynamically positioning said coil support mandrel beneath said output; and control means coupled to said wire feed means and said mandrel positioning means, said control means operable to cause said mandrel positioning means to dynamically position said coil support mandrel beneath said output such that said exiting wire is deposited onto said mandrel in a predetermined pattern, and further operable to control said wire feed means such that said first rate is substantially equal to a second rate of movement of said coil support mandrel relative to said output;

whereby said wire is deposited onto said coil support mandrel with substantially no residual winding stresses.

5. The direct wind coil winding head assembly of claim 4, further comprising:

heating means operable to heat a region near said output to a first temperature adequate to flow an adhesive coating on said wire.

6. The direct wind coil winding head assembly of claim 5, further comprising:

temperature sensing means operable to measure said first temperature.

7. The direct wind coil winding head assembly of claim 4 wherein said wire feed means comprises:

a powered shaft;

a first pinch roller driven by said powered shaft; and a second pinch roller driven by said first pinch roller, wherein said wire is held between said first and second pinch rollers and is caused to move by rotation of said powered shaft.

8. The direct wind coil winding head assembly of claim 7, further comprising:

a first gear coupled to said powered shaft and said first pinch roller;

a second gear coupled to said second pinch roller; and biasing means operative to engage said second gear with said first gear such that both said first and second pinch rollers rotate with rotation of said powered shaft.

9. The direct wind coil winding head assembly of claim 7 wherein one of said pinch rollers has a circumferential groove for nesting with said wire.

10. The direct wind coil winding head assembly of claim 7 wherein said powered shaft is adapted to be coupled for rotation to a spindle of a computer numerically controlled machine tool.

11. The direct wind coil winding head assembly of claim 4 wherein said mandrel positioning means comprise:

a longitudinal feed table of a computer numerically controlled machine tool; and a rotary table of said computer numerically controlled machine tool.

12. The direct wind coil winding head assembly of claim 4 wherein said control means is a digital computer.

13. A direct wind coil winding head assembly for depositing coil windings directly onto a coil support mandrel, comprising:

a source of rotational energy operable at variable rates of rotation;

a rotatable shaft coupled to said source of rotational energy;

wire feed means driven by said rotatable shaft and having an input and an output, said wire feed means adapted to receive a continuous length of wire at said input and to cause said wire to exit said output at a first rate;

a longitudinal feed table operable to move on a longitudinal axis;

a rotary table coupled to said longitudinal feed table and operable to rotate in a plane at substantially a right angle to said longitudinal axis;

said longitudinal feed table and said rotary table jointly operable to hold a coil support mandrel such that said mandrel may be moved along said longitudinal axis and rotated about an axis parallel to said longitudinal axis; and a digital computer coupled to and controlling said source of rotational energy, said longitudinal feed table and said rotary table, said computer operable to cause said mandrel to be dynamically positioned beneath said output according to stored program instructions and to cause said exiting wire to be deposited onto said mandrel in a predetermined pattern at a second rate substantially equal to said first rate;

whereby said wire is deposited onto said coil support mandrel with substantially no residual winding stresses.

14. The direct wind coil winding head assembly of claim 13, further comprising:

heating means coupled to and controlled by said computer and operable to heat a region near said output to a first temperature adequate to flow an adhesive coating on said wire.

15. The direct wind coil winding head assembly of claim 14, further comprising:

temperature sensing means coupled to said computer and operable to measure said first temperature, wherein said computer controls said heating means based on said measured first temperature.

16. The direct wind coil winding head assembly of claim 13 wherein said wire feed means comprises:

a first pinch roller driven by said rotatable shaft; and a second pinch roller driven by said first pinch roller, wherein said wire is held between said first and second pinch rollers and is caused to move by rotation of said rotatable shaft.

17. The direct wind coil winding head assembly of claim 16, further comprising:

a first gear coupled to said rotatable shaft and said first pinch roller;

a second gear coupled to said second pinch roller: and biasing means operative to engage said second gear with said first gear such that both said first and second pinch rollers rotate with rotation of said rotatable shaft.

18. The direct wind coil winding head assembly of claim 16 wherein one of said pinch rollers has a circumferential groove for nesting with said wire.

* * * * *